US005609225A

United States Patent [19]

Lamb et al.

[11] Patent Number: 5,609,225

[45] Date of Patent: Mar. 11, 1997

[54] COMPENSATION GUIDANCE SYSTEM

[75] Inventors: Miles P. Lamb, Chester; Louis Capuano, Westfield, both of N.J.

[73] Assignee: Inventio AG, Hergiswil NW, Switzerland

[21] Appl. No.: 428,648

[22] Filed: Apr. 25, 1995

[51] Int. Cl.[6] ..... B66B 7/02

[52] U.S. Cl. ..... 187/406; 187/414

[58] Field of Search ..... 187/278, 404–408, 187/410, 411, 414

[56] References Cited

U.S. PATENT DOCUMENTS

| | | | |
|---|---|---|---|
| H702 | 11/1989 | Shively et al. | 187/406 X |
| 763,976 | 7/1904 | Gurney | 187/405 X |
| 1,814,610 | 7/1931 | Stevelman | 187/404 |
| 3,666,051 | 5/1972 | Davis et al. | 187/414 |
| 3,991,856 | 11/1976 | Shigeta et al. | 187/404 X |
| 4,106,594 | 8/1978 | Kirsch et al. | 187/278 |
| 4,117,908 | 10/1978 | Nara et al. | 187/254 |
| 4,643,276 | 2/1987 | Philobos | 187/278 |
| 5,086,881 | 2/1992 | Gagnon et al. | 187/406 X |
| 5,103,937 | 4/1992 | Robertson . | |
| 5,105,109 | 4/1992 | Nakai et al. | 187/408 X |
| 5,203,432 | 4/1993 | Grinaski | 187/404 X |

FOREIGN PATENT DOCUMENTS

| | | | |
|---|---|---|---|
| 4131235 | 12/1979 | Japan | 187/278 |
| 1299182 | 12/1989 | Japan | 187/411 |
| 3115076 | 5/1991 | Japan | 187/278 |
| 2269575 | 2/1994 | United Kingdom . | |

*Primary Examiner*—James W. Keenan
*Attorney, Agent, or Firm*—Greenblum & Bernstein P.L.C.

[57] ABSTRACT

An apparatus for limiting the oscillation amplitude of elevator suspension and compensation elements in an elevator system. The elevator system includes a counterweight movable in guide rails with a suspension element connected to a top of the counterweight and a compensation element connected to a bottom of the counterweight. One or more limiting frames may be employed in the elevator system and each limiting frame surrounds each of the counterweight, guide rails, suspension elements, and compensation elements. Each limiting frame may be attached to the guide rails to limit lateral deflections of the suspension and compensation elements. The limiting frame may include two separate portions which are spring biased together on a stop portion located behind the guide rails, such that excessive deflection of the suspension and compensation elements cause the spring biased portions to separate and activate a safety switch.

20 Claims, 2 Drawing Sheets

COMPENSATION GUIDANCE SYSTEM

BACKGROUND OF THE INVENTION

1. Field of the Invention

The present invention pertains to an apparatus for limiting the oscillation amplitudes of suspension elements and compensation elements of elevators, preferably of an elevator utilizing a counterweight travelling in guides.

2. Discussion of the Background of the Invention and Material Information

In elevators with great lifting heights, the suspension elements and compensation elements have the tendency to oscillate in the horizontal direction. The stimulus of these oscillations has different causes, with the operation of the elevators itself being one of the main causes. During periodic accelerations, moving at high velocity and retardation, due to small deviations in the vertical plane of the guide rails, small horizontal movement components are produced by the elevator car and the counterweight. These horizontal movement components incite horizontal oscillations in the suspension and compensation elements, with the extent of these oscillations, in the self-resonant frequency region of these elements, being so large that mutual contact, as well as contact with elevator shaft apparatus occurs, which lead to damage of the installation apparatuses and interruptions of elevator operation.

The prior art includes differing apparatuses which are alleged to prevent the formation of such oscillations. U.S. Pat. No. 4,117,908 discloses a corresponding apparatus comprised of an oscillation suppressor or damper, located below the motor room ceiling in the elevator shaft and a further suppressor on the elevator car. These are constructed as a frame-like structure and include stops or buffers that are positioned closely to the suspension cables and have a greater or lesser spacing relative to the upper portion of the elevator car or the ceiling of the motor room. Upon the occurrence of cable oscillations, for example as a result of earthquakes, these oscillations are kept away from the elevator car and the elevator driving mechanism, but are not particularly limited themselves.

U.S. Pat. No. 3,666,051 discloses a further apparatus wherein cable guides, which travel with the elevator car during downward travel of the elevator car, are deposited at predetermined distances relative to each other, by means of stops or buffers at the guide rails and which during upward travel of the elevator car are again retrieved. This apparatus is designed for external elevator systems that are exposed to strong wind influences. This principle is too expensive for use in internal building installations and additionally no high velocities can be realized since the deposition and collection of the cable stabilizers causes knocking noises in the elevator car.

In the two previously-noted examples, the oscillation suppression or damping is occasioned on the elevator car side of the installation. The consideration or basis of the present invention however resides in the fact that greater oscillation movements are required on the elevator car side than on the counterweight side of the installation until the suspension and/or the compensation elements strike against a fixed or a movable installation part.

Therefore, it is the task or object of this invention, to produce an apparatus for limiting the oscillation amplitudes of suspension and compensation means on the counterweight side of the elevator installation that are simple and inexpensive as well as prohibit the contact of the suspension and/or compensation means with installation parts and which provide additional safety during extreme deflections.

SUMMARY OF THE INVENTION

The task or object of this invention is achieved in accordance with the appended claims. Specifically, this invention pertains to an apparatus for limiting the oscillations of suspension means and compensation means of elevators, with the elevator utilizing a counterweight travelling in guides, wherein the apparatus includes at least one limiting frame, with the limiting frame surrounding the guides, the counterweight, the suspension means and the compensation means. Preferably, the guides take the form of guide rails.

In a further embodiment of the apparatus of this invention, the limiting frame includes frame sections, with the frame sections including rollers, with rotational axes of the rollers being parallel with a horizontal plane. Preferably, the limiting frame is comprised of two independently movable portions.

In another embodiment of the apparatus of this invention, the frame sections include frame end pieces, with the vertical end cross-sections of the frame end pieces being larger than the corresponding cross-sections of the frame sections.

In a differing embodiment of the apparatus of this invention, each of the two movable portions of the limiting frame includes a frame end piece, with the frame end pieces yieldingly abutting against stop portions and being interconnected with springs. Preferably, the stop portions are secured to the guides.

In yet a further embodiment of the apparatus of this invention, the apparatus further includes a stop portion and a monitoring switch, so that upon the displacement of a portion of the limiting frame away from the stop portion, the monitoring switch is activated. Preferably, the monitoring switch is mounted on at least one of the guide rails and includes a contact portion.

In yet another embodiment of the apparatus of this invention, the limiting frame is detachably connected with the guide rails via stop portions and an attachment plate and the attachment plate is secured to the at least one guide rail.

A yet differing embodiment of the apparatus of this invention includes a plurality of limiting frames, wherein the limiting frames are spaced at predetermined vertical distances, wherein the vertical distances range from about 5 to about 10 meters.

The advantages of this invention, among other things, reside therein that the apparatus consists of static elements or means, without moving mechanical parts, and that throughout the entire lifting height, there is real protection from large lateral deflections of the suspension and compensation means.

A further advantage resides therein, that during extreme situations an additional safety apparatus is activated.

Furthermore, via the mutual limiting of the oscillations of this invention, contacts of fixed or movable installation parts by suspension means and particularly by compensation means are avoided without fixedly retained counterweight protectors that extend over the entire lifting height or require a separate counterweight shaft. The counterweight is always readily accessible for inspection and control operations.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

For the sake of clarity, the previously-noted designations of suspension and compensation means include all types of suspension and compensation means, which include, but are not limited to such examples as ropes, chains, bands, cables and covered or sheathed means thereof.

Figure 1:
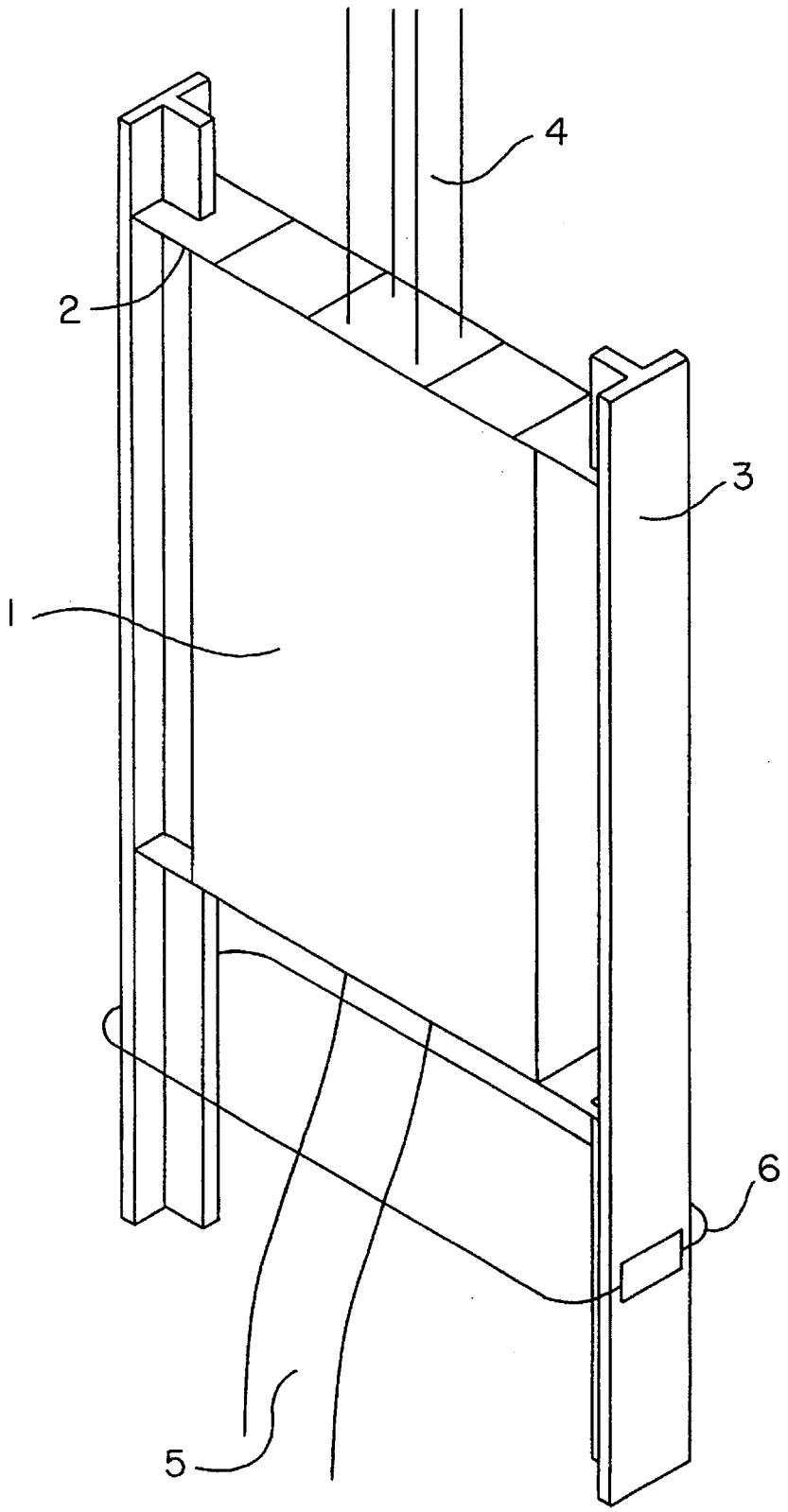
FIG. 1 is a schematic showing of an elevator counterweight together with guiding devices, suspension means, compensation means and a boundary or limiting frame of this invention.

Numeral 1 in FIG. 1 denominates a counterweight or counterbalance, which travels on guide rails 3 by means of guiding devices 2. Counterweight 1 is attached, at its upper end to suspension means 4 that preferably take the form of ropes or cables, and at its lower end has compensation means 5 attached thereto, which also preferably take the form of ropes or cables. Numeral 6 denominates a limiting or boundary frame that envelopes or surrounds guide rails 3, counterweight 1, suspension means 4 and compensation means 5, respectively.

Figure 2:
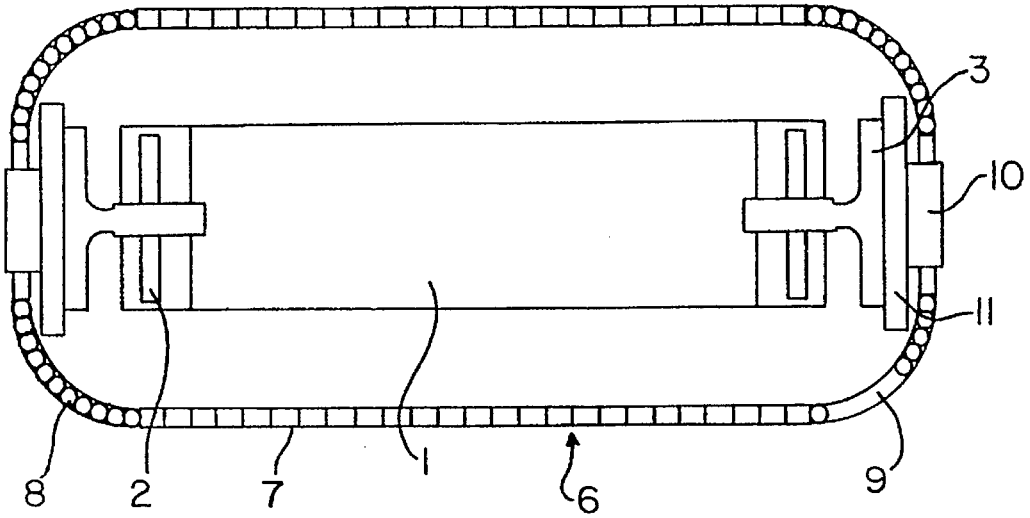
FIG. 2 is a schematic showing of the details of the boundary frame.

FIG. 2 is a schematic top plan view of the details of boundary or limiting frame 6. The load-bearing structure is formed by a frame or boundary section 9 having two straight portions, each having two curved end portions that terminate behind guide rails 3 at a stop or terminal portion 10 of an attachment plate 11. The straight portions of frame section 9 are provided with adjacent cylindrical rollers 7 while the curved portions are provided with adjacent spherical rollers whose rotational axes are parallel with the horizontal plane.

Figure 3:
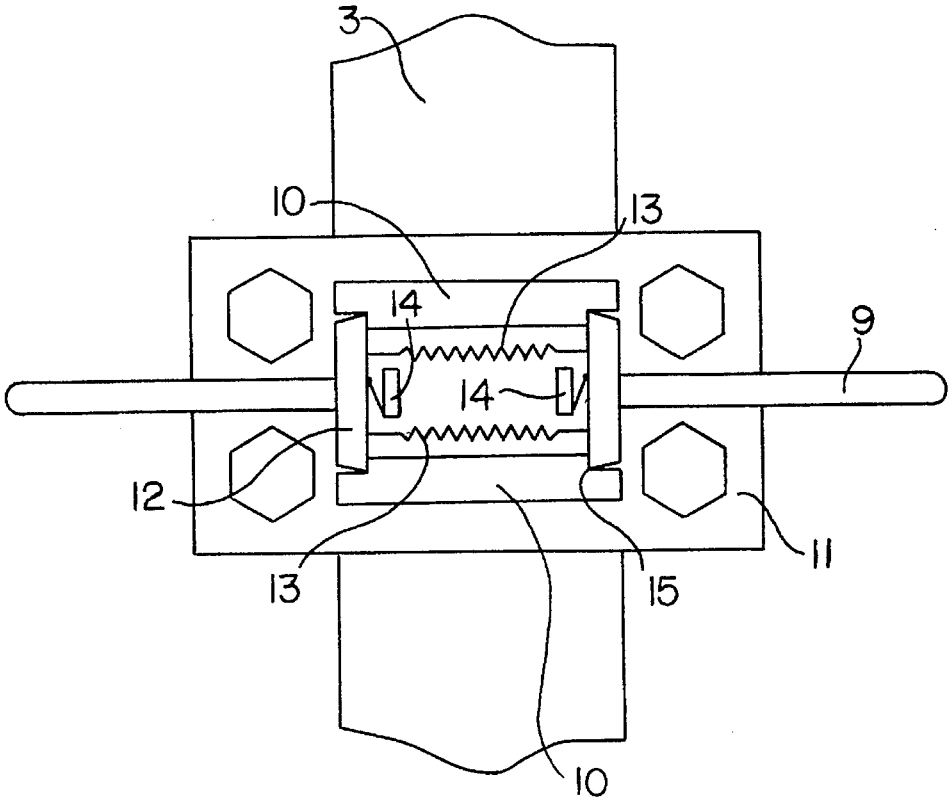
FIG. 3 is a schematic showing of the attachment and safety devices of the boundary frame.

FIG. 3 is a schematic view of the attachment and journalling of boundary frame 6, respectively of the two parts thereof that are located behind one of the two guide rails 3. Frame sections 9 terminate or are closed off at their ends by means of a plate-shaped frame end piece 12 and are interconnected by means of springs 13. The outer edges of frame end pieces 12 are spring-biased against abutment shoulders 15 of stop portions 10 which in turn are rigidly connected to attachment plate 11. Attachment plates 11 are clamped or cramped to guide rails 3, for example with clamping claws or jaws, and can thus be vertically displaced and affixed at any desired location. In the illustrated standard location, frame end pieces 12 bias or bear upon monitoring switches 14 and keep switch contacts thereof in the closed position. The contacts are, for example, switched in series, and form a portion of the elevator safety circuit.

The installation and function of the device or apparatus of this invention will now be described in detail.

Boundary frame 6 forms, with all the parts shown in FIGS. 2 and 3, a complete and self-contained prefabricated subassembly. For the dimensions to be accommodated, the track width of counterweight guide rails 3 and the thickness of counterweight 1 must be taken into account. For each elevator installation, boundary section 9 can be installed in one or more portions via simple clamping to guide rails 3 of counterweight 1. The vertical distance between two boundary frames 6, depending upon the oscillation or vibration susceptibility of the suspension and compensation means 4 and 5, respectively, can, for example, have values of between five and ten meters. The lowermost boundary frame 6 is affixed as closely as possible to the lower return or reversing loop, since the translatory deflections or swings of compensation means 5 are greatest at that location.

During mid-range translatory deflections of suspension means 4 or compensation means 5, low friction contact occurs with boundary frame 9 via rollers 7 or 8. When the translatory deflections increase to such an extent that the contact with boundary frame 6 includes a substantial impact force, a portion of boundary frame 6, including frame end pieces 12 is more or less pulled away from abutment shoulder 15, which in turn overcomes the biasing force acting against monitoring switch 14 and thereby opens the contacts thereof. This in turn causes the interruption of the elevator safety circuit and results in an emergency stop with subsequent switching-off of the installation. Such an occurrence or event of course assumes an extensive disturbance, as for example an earthquake or defective parts of the compensation means 5, etc., thus justifying the immediate shutdown of the elevator installation.

Instead of utilizing rollers 7 and 8, frame section 9, that is its cross section, can be so formed or shaped that a low friction upper surface is provided via a suitable material layer and/or via a gentle geometrically repelling or receding form, for example a flat semicircular shape on the contact side thereof.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. An apparatus for limiting suspension means oscillations and compensation means oscillations in an elevator system, the elevator system including a counterweight, at least one guide for guiding movement of the counterweight, suspension means coupled to a top portion of the counterweight, and compensation means coupled to a bottom portion of the counterweight, said apparatus comprising:

at least one limiting frame defining a boundary;

said at least one limiting frame for attaching to the at least one guide; and said boundary for surrounding the at least one guide, the counterweight, the suspension means, and the compensation means; and said at least one limiting frame for limiting deflections of the suspension means and compensation means due to oscillations.

2. The apparatus of claim 1, wherein said limiting frame includes frame sections, with said frame sections including rollers, with rotational axes of said rollers being parallel with a horizontal plane.

3. The apparatus of claim 2, wherein said frame sections include frame end pieces having a larger cross-section than said frame sections.

4. The apparatus according to claim 3, said frame end pieces forming a T at an end of said frame sections.

5. The apparatus of claim 1, wherein said limiting frame is comprised of two independently movable portions.

6. The apparatus of claim 5, wherein each of said two movable portions of said limiting frame includes a frame end piece, with said frame end pieces yieldingly abutting against stop portions and being interconnected with springs.

7. The apparatus of claim 6, wherein said stop portions are secured to the guides.

8. The apparatus of claim 6, wherein said apparatus further includes a stop portion and a monitoring switch, so that upon displacement of a portion of said limiting frame away from said stop portion, said monitoring switch is activated.

9. The apparatus of claim 5 wherein said apparatus further includes a stop portion and a monitoring switch, so that upon the displacement of a portion of said limiting frame away from said stop portion, said monitoring switch is activated.

10. The apparatus of claim 9, wherein the at least one guide comprise guide rails and said monitoring switch is mounted on at least one of the guide rails.

11. The apparatus of claim 9, wherein said monitoring switch includes a contact portion.

12. The apparatus of claim 1, wherein the at least one guide includes at least one guide rail and wherein the limiting frame is detachably connected with the at least one guide rail via stop portions and an attachment plate.

13. The apparatus of claim 12, wherein said attachment plate is secured to the at least one guide rail.

14. The apparatus of claim 1, wherein said limiting frame is comprised of two independently movable portions, with said apparatus further including a stop portion and a monitoring switch, so that upon displacement of a portion of said limiting frame away from said stop portion, said monitoring switch is activated.

15. The apparatus of claim 1, wherein said limiting frame is comprised of two independently movable portions, and wherein each of said two movable portions of said limiting frame includes a frame end piece, with said frame end pieces yieldingly abutting against stop portions and being interconnected with springs.

16. The apparatus of claim 1 including a plurality of limiting frames, wherein said limiting frames are spaced at predetermined vertical distances.

17. The apparatus of claim 16, wherein said vertical distances range from about 5 to about 10 meters.

18. The apparatus according to claim 1, each of said at least one limiting frame further comprising a monitoring device for indicating when a deflection of the suspension means or of the compensation means extends said boundary.

19. An apparatus for limiting suspension means oscillations and compensation means oscillations in an elevator system, the elevator system including a counterweight, at least one guide for guiding movement of the counterweight, suspension means coupled to a top portion of the counterweight, and compensation means coupled to a bottom portion of the counterweight, said apparatus comprising:

limiting means for establishing a boundary around the at least one guide, the counterweight, the suspension means, and the compensation means;

coupling means for attaching said limiting means to the at least one guide; and said limiting means further for limiting deflections of the suspension means and the compensation means.

20. The apparatus according to claim 19, said limiting means comprising monitoring means for indicating when a deflection of the suspension means or of the compensation means extends said boundary.

* * * * *